US005634297A

United States Patent [19]

Ito

[11] Patent Number: 5,634,297

[45] Date of Patent: Jun. 3, 1997

[54] DOOR OPENING/CLOSING APPARATUS

[75] Inventor: Sumio Ito, Kanagawa, Japan

[73] Assignee: Teraoka Auto-Door Hanbai Co., Ltd., Japan

[21] Appl. No.: 366,828

[22] Filed: Dec. 30, 1994

[30] Foreign Application Priority Data

Dec. 30, 1993 [JP] Japan ..... 5-076041 U

[51] Int. Cl.[6] ..... E05F 11/00

[52] U.S. Cl. ..... 49/360

[58] Field of Search ..... 49/360, 141, 324

[56] References Cited

U.S. PATENT DOCUMENTS

| | | | |
|---|---|---|---|
| 3,670,455 | 6/1972 | Slaybaugh | 49/141 X |
| 3,863,390 | 2/1975 | Sawdai | 49/360 |
| 3,872,622 | 3/1975 | Berk | 49/360 X |
| 4,067,144 | 1/1978 | Ogishi | 49/360 |
| 4,330,960 | 5/1982 | Hasemann et al. | 49/360 X |
| 4,882,876 | 11/1989 | Daugirdas | 49/141 |
| 5,127,190 | 7/1992 | Hein et al. | 49/360 X |
| 5,220,746 | 6/1993 | Yeager | 49/360 |
| 5,247,763 | 9/1993 | Hein | 49/141 X |
| 5,301,468 | 4/1994 | Kamezaki | 49/358 X |
| 5,440,837 | 8/1995 | Piltingsrud | 49/360 X |

*Primary Examiner*—Kenneth J. Dorner
*Assistant Examiner*—Jerry Redman
*Attorney, Agent, or Firm*—Ostrolenk, Faber, Gerb & Soffen, LLP

[57] ABSTRACT

A door opening/closing apparatus, which can cause quick and smooth start of movement of a sliding door in an emergency, without any possibility of breakage of the door due to quick movement, so that it can be used reliably and safely. When an operating member is released from its lock, it is pulled along with the sliding door, by a uniform force. To start movement of the operating member, a pushing member mounted on a slidable member is pushed by the spring forces of two coil springs, thus aiding the operation of pushing the operating member and permitting quick and smooth start of movement of the operating member, sliding door, etc. With the screwing of an adjustment screw, the spring force of an adjustment spring is adjusted. The adjusted spring force causes a pushing member to be pushed against a guide member via a pivotal member and a pushing member to effect adjustment of the speed of movement of the operating member for braking action.

14 Claims, 3 Drawing Sheets

DOOR OPENING/CLOSING APPARATUS

BACKGROUND OF THE INVENTION

1. Field of the Invention

This invention relates to a door opening/closing apparatus for automatically moving a sliding door to close or open an entrance/exit in case of emergency.

2. Description of the Related Art

Heretofore, many door opening/closing apparatuses have been used, in which sliding doors are moved reciprocally to open and close an entrance/exit or the like. In case of emergency, it may be necessary to move sliding doors that are open in the closing direction to close an entrance/exit or the like. Conversely, closed sliding doors may need to be moved in the opening direction to open the entrance/exit or the like.

For example, to prevent intrusion of smoke or the like generated, due to a fire or a similar cause, into other places, it is necessary to move the open sliding doors in the closing direction so as to close the entrance/exit or the like. Conversely, closed sliding doors may have to be opened at an entrance/exit to a building or the like for escapement therefrom in case of fire, power stoppage, etc.

The sliding door, however, is usually manufactured rigidly, and can be considerably heavy. Such a heavy sliding door requires a strong force to cause its manual sliding. This means that it takes a considerable amount of time for a person inside a building, for example, to escape, which is undesirable at the time of power stoppage, or in case of another emergency.

Meanwhile, a uniform tension spring provides uniform spring force and hence provides a constant torque at all times, which is convenient. However, as described above, the sliding door of the automatic door opening/closing apparatus is usually manufactured rigidly, and is considerably heavy, requiring a very strong force to move the door. Meahwhile, the uniform tension spring provides a uniform force at all times. Particularly, the force is insufficient at the time of the start of movement of the sliding door, and there are situations in which the sliding door can not be moved quickly and smoothly.

Further, in the maintenance and inspection of the operating member, there are situations requiring moving only the operating member, without moving the sliding door. As described above, however, it is necessary to increase the spring force of the uniform tension spring, in which case, the operating member, when moved alone, will move quickly, and therefore the operating member, the door, etc. can be damaged by impacts. In fact, damage to the door, etc. by impacts is likely due to quick movement.

SUMMARY OF THE INVENTION

Accordingly, the present invention provides a door opening/closing apparatus, which permits a sliding door to be moved quickly and smoothly at the time of the start of movement, particularly in case of emergency.

The apparatus according to the invention comprises a mechanism for a sliding door to be driven reciprocally to open and close an entrance/exit or the like. A guide member extends in the directions of movement of the sliding door. An operating member to be guided by the guide member slides in the direction of opening or closing the sliding door. An operating member locking mechanism is provided for locking and unlocking the operating member, the lock being released by an electrical signal or manually.

A uniform tension spring is disposed between the frame of the entrance/exit or the like and the operating member. The spring pulls the operating member in the direction of closing or opening the sliding door, and a movement aiding member aids the movement of the operating member at the time of the start of movement of the operating member, wherein when the lock of the operating member is released in case of emergency or the like, at the time of the start of the operating member for moving the sliding door both the spring force of the uniform tension spring and movement of the aiding member provide action to cause movement of the operating member.

Thus, when starting the movement of the sliding door in case of emergency such as fire, power stoppage, etc., both the uniform tension spring and the movement aiding member provide action to permit quick and smooth start of movement of the sliding door. Further, when the sliding door has been moved to a certain extent, it is pulled by the spring force of the uniform tension spring at all times, so that it can be moved reliably and quickly.

The invention also provides a door opening/closing apparatus, which, when the lock of an operating member is released in case of emergency or the like, permits the sliding door to be moved automatically in the closing or opening direction. In addition, the operating member of the present invention, in the maintenance or inspection thereof, is not moved quickly, so that there is no possibility of damage to the operating member, the door, etc. by impacts, and it can be used reliably and safely for a long time.

According to the invention, at the time of the start of movement of the sliding door, both the uniform tension spring and the movement aiding member act on the operating member for moving the sliding door, thus permitting quick and smooth start of the operating member and the door in case of emergency.

Further, in case of emergency the spring force of the uniform tension spring acts to permit the sliding door to be pulled by a uniform tensile force via the operating member at all times. In addition, the pushing member, with the pushing force thereof adjusted, pushes the guide member with a predetermined force. The operating member thus is not moved quickly, but is moved smoothly at all times. Thus, there is no possibility of damage to the operating member, the door, etc. by impacts, and the apparatus can be used safely and reliably for a long time.

Other features and advantages of the present invention will become apparent from the following description of the invention which refers to the accompanying drawings.

DETAILED DESCRIPTION OF THE PREFERRED EMBODIMENTS

Figure 1:
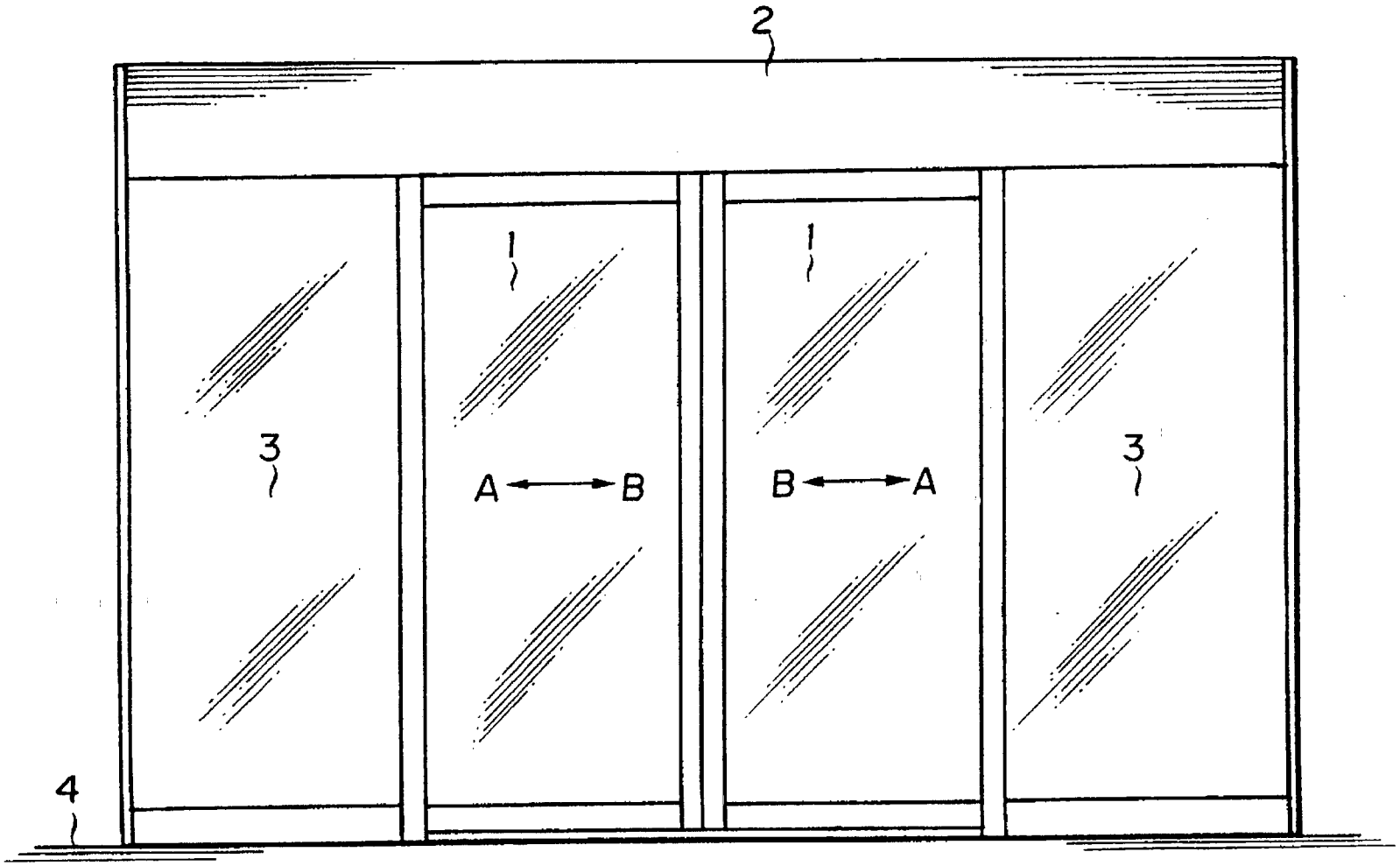
FIG. 1 is a front view showing one embodiment of the present invention.

Now the invention will be described in conjunction with an embodiment thereof illustrated in the drawings. Referring to FIG. 1, there is provided a door opening and closing apparatus, which comprises a sliding door 1 to be driven reciprocally to open and close an entrance or exit or the like, a guide member 7 extending in the direction of movement of the sliding door 1, an operating member 8 to be guided by the guide member 7 for sliding in the direction of closing or opening the sliding door 1, an operating member locking mechanism for locking and unlocking the operating member 8, the lock being released by an electrical signal or manually, a uniform tension spring disposed between the frame 2 of the entrance or exit or the like and the operating member 8 and pulling the operating member 8 in the direction of closing or opening the sliding door 1, a movement aiding member for aiding the movement of the operating member 8 at the time of the start of movement of the operating member, a pushing member 20 mounted for vertical movement on the operating member 8 and pushing the guide member 7, and an adjustment member for adjusting the pushing force of the pushing member 20.

The two sliding doors 1 are slidable in lateral directions. These sliding doors 1 each have rollers (not shown) provided on opposite end portions of the top. The doors are moved with the rolling of these rollers along an upper rail (not shown) laid in a frame 2 so as to extend in a horizontal direction, i.e., along the directions of movement of the two doors 1. The doors are coupled separately to upper and lower runs of a belt passed around two pulleys such that the doors are moved in mutually opposite directions, that is, when one door is moved in one direction, the other one is moved in the opposite direction. The doors are opened when they are moved in the directions of arrow A and are closed when they are moved in the directions of arrows B. Door accommodation units 3 are provided on the opposite sides of the sliding doors 1 such that they are deviated from the path of the doors. The two door accommodation sections 3 have their upper part mounted on the frame 2 and their lower part mounted on a floor 4.

Figure 2:
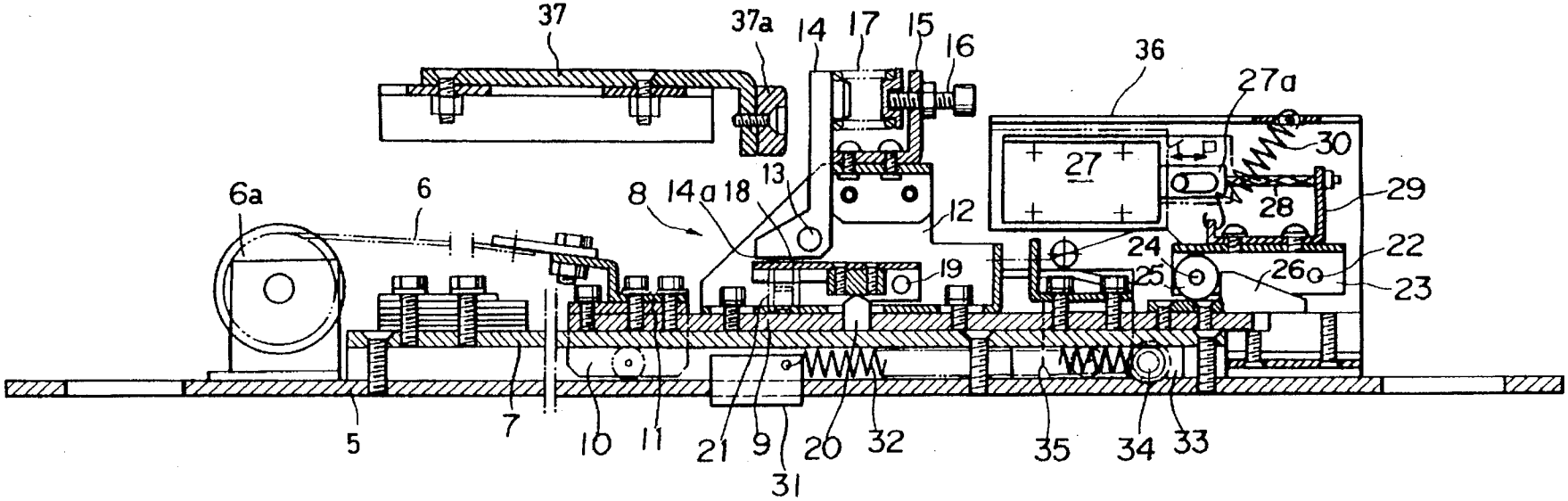
FIG. 2 is a side view showing an essential machanism of the same embodiment of the present invention.
Figure 3:
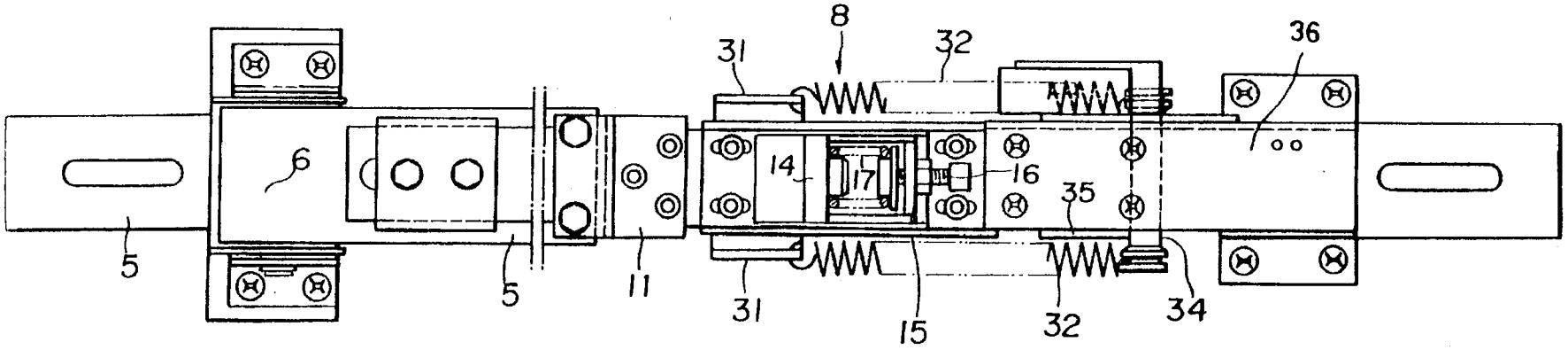
FIG. 3 is a plan view of the mechanism shown in FIG. 2.

Now an embodiment of the door opening and closing apparatus will be described with reference to FIGS. 2 and 3. The embodiment concerns a case where the sliding doors 1 are normally open and closed in case of emergency. A mountable, uniform-tension spring 6 has a take-up section 6*a* secured to one end portion of a mounting member 5 secured to the frame 2. A guide member 7 having a substantially T-shaped sectional profile is secured to the mounting member 5 such that it extends in the directions of movement of the sliding door 1. An operating member 8 has a slidable member 9 slidable in the directions of movement of the sliding door 1.

Engagement members 10 are secured to opposite end portions of the slidable member 9 and engage with opposite end portions of the guide member 7. The uniform tension spring 6 has its open terminal section secured to a mounting member 11 secured to the slidable member 9 of the operating member 8. Thus, the spring force of the uniform tension spring 6 has an effect that the slidable member 9 is pulled by a uniform pulling force at all times.

A support bar 12 is secured to the other end portion of the slidable member 9. A pivotal member 14 has one end portion pivotally coupled by a pin 13 to the support bar 12. An adjustment screw 16 is screwed in an upper portion of an L-shaped mounting member 15 which is secured to the support bar 12. An adjustment spring 17 which is a coil spring is provided between the inner side of the mounting member 15 and the pivotal member 14, and it has an end portion coupled to a projecting end portion of the adjustment screw 16 such that the spring force of the spring 17 is adjustable by screwing the screw 16.

Further, a pushing member 18 is disposed underneath the pivotal member 14, and has one end portion pivoted by a pin 19 to the slidable member 9. Under a central portion of the pushing member 18, a pin-like pushing member 20 is inserted for vertical movement in the slidable member 9, the upper end thereof is held in contact with the underside of the pushing member 18, and the lower end surface of the pushing member 20 is held in slidable contact with the top surface of guide member 7.

In this state, with the pivotal member 14 caused by the spring force of the adjustment spring 17 to undergo rocking about the pin 13, an end 14*a* of the member 14 pushes the open end of the pushing member 18, and also the pushing member 18 pushes the pushing member 20, thus causing the member 20 to push on the guide member 7. In consequence, the slidable member 9 is provided with a braking function, thus permitting adjustment of the speed of movement of the slidable member 9 or the like.

It is possible to adjust the pushing force of the pushing member 20 by adjusting the spring force of the adjustment spring 17 through screwing of the adjustment screw 16. A coil spring 21 is provided between the underside of the open end portion of the pushing member 18 and the slidable member 9.

The operating member 8 has a locking mechanism which will now be described. A pivotal member 23 has an end portion pivotally mounted by a pin 22 on the mounting member 5, and a rotary locking member 25 is rotatably mounted by a pin 24 to the open end portion of the pivotal member 23 such that it can be locked to and unlocked from a hook 26 projecting from the rear end of the slidable member 9.

Further, an electromagnetic solenoid 27 is secured to a solenoid mounting member 36 which is secured to the mounting member 5. The solenoid 27 has a plunger 27*a*, which is coupled by a coupler 28 to a mounting member 29 secured to the top of the pivotal member 23. A tension spring 30 is provided between the mounting piece 29 and the solenoid mounting member 36.

While the electromagnetic solenoid 27 is energized, the plunger 27*a* thereof has sunken in the direction of arrow a. Thus, the rotary locking member 25 is held locked to the hook 26. When the solenoid 27 is deenergized, the plunger 27*a* is caused to project in the direction of arrow b so as to cause the open end of the pivotal member 23 to be raised by the spring force of the tension spring 30, whereby the rotary locking member 25 is detached from the hook 26 to release the lock of the operating member 8.

Now an aiding member will be described, which aids the movement of the operating member 8 or the like when causing the movement thereof. Underneath the slidable member 9, a mounting member 31 is secured to the mounting member 5. Two coil springs 32 each have one end mounted on each transverse end of the mounting member 31. The other end, i.e., open end, of each coil spring 32 is mounted on each transverse end of a pushing bar 34, which is disposed in a space 33 between the mounting member 5 and the guide member 7 for movement in the directions of movement of the sliding door 1. The pushing bar 34 is held in contact with pushing member 35 secured to the slidable member 9 while it is pulled by the spring forces of the two coil springs 32. When causing the movement of the slidable member 9, the pushing bar 34 pushes the pushing member 35 with the spring forces of the two coil springs 32, thus aiding the movement of the slidable member 9, etc.

Designated at 37 is a door drive member which is secured to an upper end portion of the sliding door 1. A pushing piece 37*a* made of hard rubber is secured to an end portion of the door drive member 37 such that it faces the pivotal member 14 with a slight spacing between the two. When the pivotal member 14 of the operating member 8 is pulled by the spring force of the uniform tension spring 6 and moved slightly, it is brought into contact with the pushing piece 37*a* of the door drive member 37. Thereafter, the member is pushed by the pivotal member 14 to be moved in a direction of closing the siding door 1.

The operation of the mechanism having the above construction will now be described. In the event of smoke generation due to fire, with the sliding doors in the open state, for example, to prevent the smoke from flowing into other rooms, the open sliding doors 1 have to be closed. To this end, the power supply to the electromagnetic solenoid 27 is cut off. As a result, the plunger 27*a* of the electromagnetic solenoid 27 is caused to project in the direction of arrow b. Thus, the open end of the pivotal member 23 is raised by the spring force of the tension spring 30, thus causing the rotary locking member 25 provided on the open end of the pivotal member to be detached from the hook 26 to release the lock of the operating member 8 or the like.

When the lock is released, the spring force of the uniform tension spring 6 causes the slidable member 9, etc. of the operating member 8 to be pulled by uniform force and moved along the guide member 7 toward the take-up section 6*a* of the uniform tension spring 6. Thus, the pivotal member 14 of the operating member 8 is moved slightly into contact with the pushing piece 37*a* of the door drive member 37, whereby the door drive member 37 is pulled by the spring force of the uniform tension spring 6 via the pivotal member 14. As a result, the sliding door 1 is moved in unison with the door drive member 37 in the closing direction.

At the start of movement of the sliding door, the pushing piece 35 is pushed by the spring forces of both coil springs 32. The spring forces of the coil springs 32 thereby aide the movement of the slidable member 9, etc. of the operating member 8. Thus, at the time of the start of movement, the spring forces of the uniform tension spring 6 and the two coil springs 32 act together, and the sliding door 1 can be caused to be moved smoothly and quickly with the operating member 8, etc. in the closing direction (i.e., direction of arrow B, FIG. 1).

When the operating member 8, etc. has moved to a certain extent, the coil springs collapse, and the pushing piece separates from the pushing member. The spring forces of the two coil springs 32 no longer acting on the slidable member. Thus, subsequently, the sole spring force acting on the operating member, and the door, is that of the uniform tension spring 6 causes the. operating member 8, etc. to be pulled by uniform force at all times, thus being moved to close the entrance/exit.

When the pivotal member 14 is brought into contact with the door drive member 37, the member 14 is slightly pivoted against the spring force of the adjusting spring. Thus, the pushing force of the pushing member 20 is reduced, resulting in substantial reduction or removal of the brake action of pushing member 20.

When performing maintenance and inspection of the operating member 8 with the sliding door 1 in the closed state, the door drive member 37 of the sliding door 1 is moved in the closed state, thus allowing movement of the operating member 8 without impediment by the weight of the door. At this time, the spring force of the adjustment spring 17 that has been adjusted through screwing of the adjustment screw 16 also causes pivotal motion of the pivotal member 14 about the pin 13, causing the end of the pivotal member 14 to push the open end top surface of the pushing member 18. The pushing member 18 thus pushes down the pushing member 20, so that the underside thereof is elastically pushed against the guide member 7 to slide along the same, and providing the action of braking the operating member 8.

Since some braking action is provided with the pushing member 20 pushed against the guide member 7 by the spring force of the adjustment spring 17 with the spring force thereof having been adjusted, the operating member 8 is not moved quickly. Thus, there is no possibility for the operating member 8, sliding door 1, etc. to be broken by impacts, and it is possible to ensure long use.

The above embodiment has been described in connection with sliding doors 1 which are normally open and must be closed in case of emergency. In the converse case when the sliding doors 1 are normally closed and must be opened in case of emergency, it is necessary only to set the mechanism conversely, and no description in this connection is given.

Further, while the above embodiment has been applied to the case where there are two sliding doors 1, the invention is, of course, applicable as well to the case of a single, three, four, etc. sliding doors.

Additionally, while the above embodiment has been described in which the lock of the operating member locking mechanism is operated by an electric signal, it is possible as well to permit manual releasing of the lock.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A door opening and closing apparatus for a sliding door driven reciprocally in alternate directions with respect to a door frame to open and close an entrance or exit, the apparatus comprising:

a guide member adapted to be disposed on the frame and adapted to extend in the directions of movement of the sliding door;

an operating member sliding on and guided by the guide member for moving the sliding door in a selected one of the directions of closing or opening of the sliding door;

an operating member locking member disposed on the operating member for selectively preventing and allowing sliding of the operating member with respect to the guide member;

a uniform tension spring to be disposed between the frame and the operating member for pulling the operating member with respect to the frame in a selected one of the directions of closing and opening the sliding door;

a movement aiding member disposed on the guide member for aiding the sliding of the operating member;

a brake member disposed on the operating member for braking the movement of the operating member on the guide member; and an adjustment member for adjusting the braking force of the brake.

2. The door opening and closing apparatus according to claim 1, wherein the brake member comprises a brake release member engageable with the sliding door for releasing the brake member upon pushing of the sliding door by the operating member.

3. The door opening and closing apparatus according to claim 2, wherein the brake release member has a pivotal member pivotally supported by the slidable member, the pivotal member being moved in contact with a door drive member adapted to be secured to the sliding door.

4. The door opening and closing apparatus according to claim 2, wherein the operating member includes a sliding member and has a pivotal member pivotally supported by the sliding member, the pivotal member being moved in contact with a door drive member adapted to be secured to the sliding door.

5. The door opening and closing apparatus according to claim 2, wherein the adjustment member includes an adjusting screw and an adjusting spring for adjusting a pivotal motion of a pivotal member.

6. The door opening and closing apparatus according to claim 1, wherein the operating member locking member includes an electromagnetic solenoid.

7. The door opening and closing apparatus according to claim 1, wherein the movement aiding member includes a spring member adapted to aid the movement of the sliding door.

8. The door opening and closing apparatus according to claim 1, wherein the adjustment member includes an adjusting screw and an adjusting spring for adjusting a pivotal motion of a pivotal member.

9. The door opening and closing apparatus of claim 1, wherein the brake member includes a pushing member disposed on the operating member and vertically moveable to push against the guide member.

10. A door opening and closing apparatus of claim 1, wherein the movement aiding member operates to move the sliding door during an initial portion of the sliding door closing movement.

11. A sliding door comprising:

a frame;

the sliding door disposed on the frame so as to move, with respect to the frame, in alternate directions, the sliding door moving a distance between an open position and a closed position;

a guide member disposed on the frame and extending in the directions of movement of the sliding door;

an operating member slidably disposed on the guide member and engageable with the sliding door to move the sliding door along a distance;

a locking member disposed on the operating member and selectively preventing and allowing sliding of the operating member with respect to the guide member;

a uniform tension device disposed between the frame and the operating member and urging the operating member along the guide member in a selected direction;

a movement aiding member disposed on the guide member, the movement aiding member separably engaging the operating member and urging the operating member in the selected direction; and a brake member disposed on the operating member and frictionally engageable with the guide member.

12. The door of claim 11, wherein the brake member includes an adjustment member adjustably urging the brake member into the frictional engagement with the guide member.

13. The door of claim 11, wherein the brake member includes a pivotal member, the pivotal member engageable with the door such that, when the door is engaged with the pivotal member, the brake member is disengaged from the guide member.

14. The door of claim 11, wherein the movement aiding member urges the operating member in the selected direction during a portion of the distance traveled by the door.

* * * * *